US007567212B2

(12) United States Patent
Inoue et al.

(10) Patent No.: US 7,567,212 B2
(45) Date of Patent: Jul. 28, 2009

(54) ELECTRONIC EQUIPMENT UNIT

(75) Inventors: Takeshi Inoue, Saitama (JP); Takashi Hara, Kanagawa (JP); Ayumu Nomura, Saitama (JP); Daisuke Shiono, Tokyo (JP); Takayuki Wada, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 12/034,128

(22) Filed: Feb. 20, 2008

(65) Prior Publication Data

US 2008/0231538 A1 Sep. 25, 2008

(30) Foreign Application Priority Data

Feb. 28, 2007 (JP) ..... 2007-050759

(51) Int. Cl.
*H01Q 1/24* (2006.01)

(52) U.S. Cl. ..... 343/702; 343/872; 343/882; 455/90.3

(58) Field of Classification Search ..... 343/702, 343/713, 872, 882; 455/90.3
See application file for complete search history.

(56) References Cited

U.S. PATENT DOCUMENTS

2006/0035684 A1* 2/2006 Guo ..... 455/575.1

FOREIGN PATENT DOCUMENTS

| | | |
|---|---|---|
| JP | 2001-4387 | 1/2001 |
| JP | 2003-204380 | 7/2003 |
| JP | 2004-312722 | 11/2004 |
| JP | 2005-41441 | 2/2005 |
| JP | 2005-109676 | 4/2005 |

* cited by examiner

*Primary Examiner*—Tan Ho
(74) *Attorney, Agent, or Firm*—Oblon, Spivak, McClelland, Maier & Neustadt, P.C.

(57) ABSTRACT

Disclosed herein is an electronic equipment unit having a cradle, electronic equipment detachably mounted to the cradle, and a connecting mechanism for detachably connecting the electronic equipment to the cradle. The electronic equipment has a housing, an antenna case connected to the back side of the housing, and a recess formed on the back side of the housing for receiving the antenna case. The antenna case is pivotable between a retracted condition where the antenna case is retracted in the recess and a raised condition where the antenna case is raised from the back side of the housing. The cradle has a connecting portion adapted to be received in the recess in the raised condition of the antenna case. The connecting portion is detachably connected to the recess by the connecting mechanism in the condition where the antenna case is raised and the connecting portion is received in the recess.

13 Claims, 15 Drawing Sheets

ELECTRONIC EQUIPMENT UNIT

CROSS REFERENCES TO RELATED APPLICATIONS

The present invention contains subject matter related to Japanese Patent Application JP 2007-050759 filed in the Japan Patent Office on Feb. 28, 2007, the entire contents of which being incorporated herein by reference.

BACKGROUND OF THE INVENTION

1. Field of the Invention

The present invention relates to an electronic equipment unit.

2. Description of the Related Art

As a structure for detachably mounting electronic equipment such as a navigation device to an automobile or the like, it has been proposed that a cradle having an opening exposed to a compartment is preliminarily installed in a dashboard and that the electronic equipment is removably inserted into the cradle through the opening thereof (see Japanese Patent Laid-open No. 2005-41441).

In this structure, the insertion/removal of the electronic equipment into/from the cradle is attained by moving the electronic equipment through the opening thereof in the longitudinal direction of the automobile.

In the past structure mentioned above, however, the mounting position of the electronic equipment to the automobile is preliminarily fixed and cannot be changed.

In the case that the mounting position of the electronic equipment to the automobile is made changeable, it is considered that the cradle may be exposed to the compartment so as to make the mounting position changeable. Accordingly, there arises a problem as to how the mounted condition of the electronic equipment to the cradle is made compact.

SUMMARY OF THE INVENTION

There is a need for the present invention to provide an electronic equipment unit which can attain a compact mounted condition of the electronic equipment to the cradle.

In accordance with an embodiment of the present invention, there is provided an electronic equipment unit including: a cradle adapted to be attached to a mobile unit; electronic equipment detachably mounted to the cradle; and a connecting mechanism for detachably connecting the electronic equipment to the cradle. The electronic equipment includes a housing, an antenna case connected to the back side of the housing for containing a GPS antenna, a recess formed on the back side of the housing for receiving the antenna case, and a display surface formed on the front side of the housing for displaying an image according to positioning waves received by the GPS antenna. The antenna case is pivotable between a retracted condition where the antenna case is retracted in the recess and a raised condition where the antenna case is raised from the back side of the housing. The cradle has a connecting portion adapted to be received in the recess in the raised condition of the antenna case. The connecting portion of the cradle is detachably connected to the recess by the connecting mechanism in the condition where the antenna case is raised and the connecting portion is received in the recess.

According to an embodiment of the present invention, the connecting portion of the cradle is connected to the recess of the housing of the electronic equipment in the condition where the connecting portion is received in the recess.

Accordingly, the mounted or connected condition of the electronic equipment to the cradle can be made compact.

Other needs and features of the invention will be more fully understood from the following detailed description and appended claims when taken with the accompanying drawings.

DETAILED DESCRIPTION OF THE PREFERRED EMBODIMENTS

Figure 1:
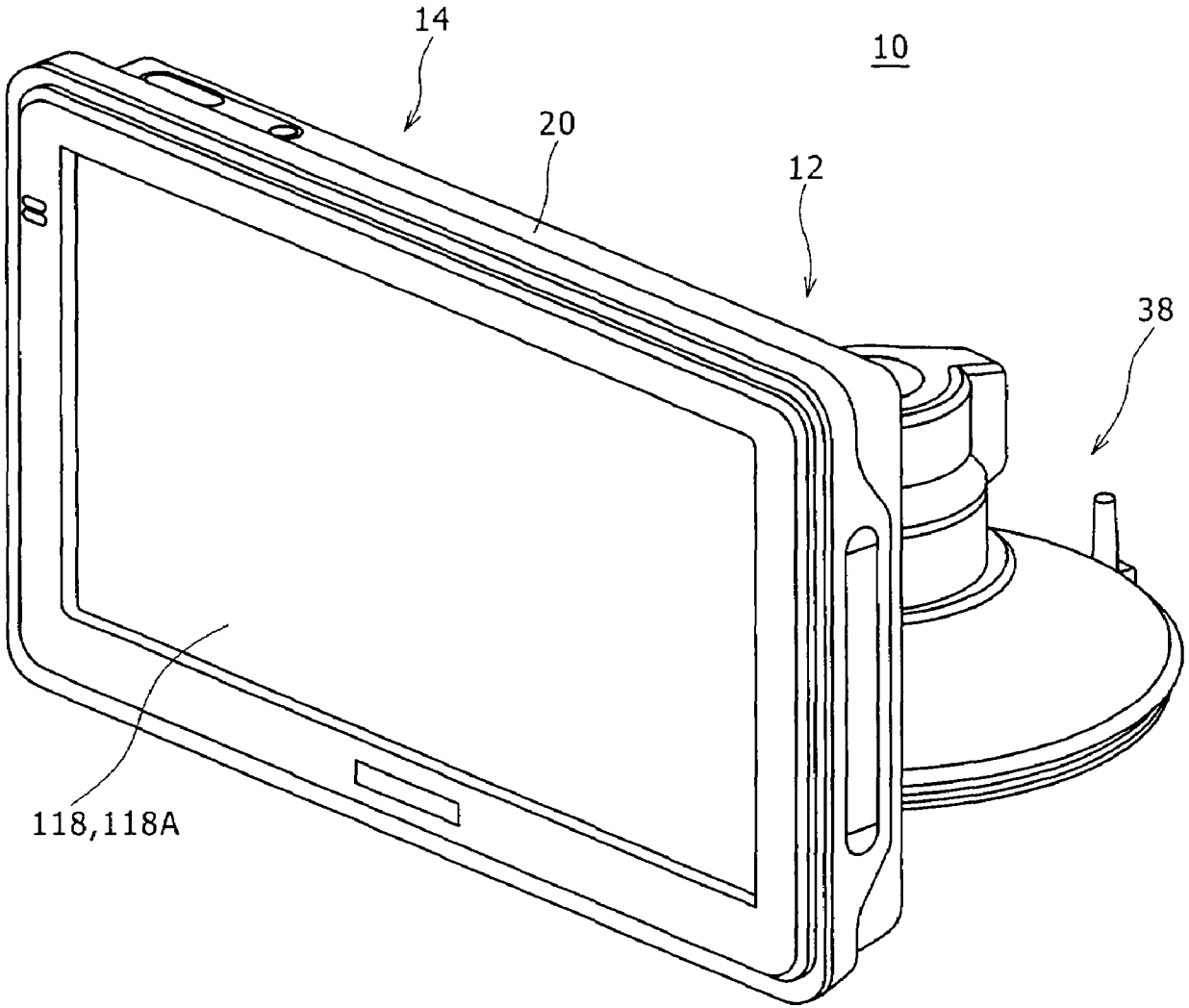
FIG. 1 is a front perspective view of an electronic equipment unit according to a preferred embodiment of the present invention.

A preferred embodiment of the present invention will now be described with reference to the drawings.

In the drawings, reference numeral 10 generally denotes an electronic equipment unit according to a preferred embodiment of the present invention, wherein the electronic equipment unit 10 is a personal navigation device (PND) for use in a vehicle.

Figure 15:
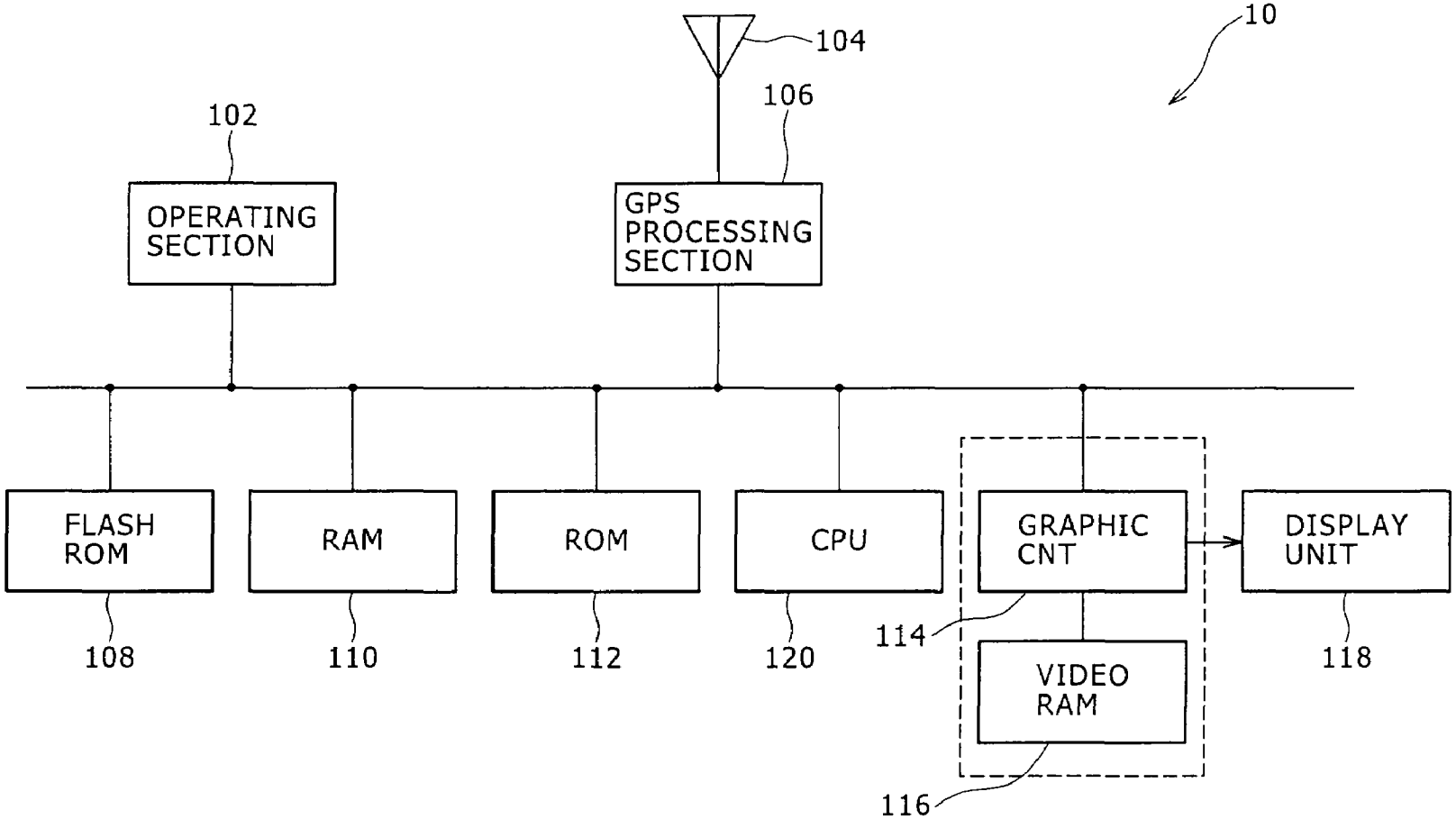
FIG. 15 is a functional block diagram of the electronic equipment unit according to the present embodiment.

FIG. 15 is a functional block diagram of the electronic equipment unit 10.

The electronic equipment unit 10 includes an operating section 102, GPS antenna 104, GPS processing section 106, flash ROM 108, RAM 110, ROM 112, graphic controller 114, video RAM 116, display unit 118, and CPU 120. These components are connected to each other through an internal bus.

The operating section 102 includes a power switch and operating switches for making various settings. The operating section 102 may include a pointing device such as a touch panel provided on the display surface of the display unit 118.

The GPS processing section 106 functions to receive positioning waves transmitted from a GPS satellite through the GPS antenna 104, to detect the position of the electronic equipment unit 10 according to the positioning waves received, and to generate position data indicative of the position detected above.

The flash ROM 108 functions to store a program to be executed by the CPU 120.

The RAM 110 functions to store data to be used in the processing by the CPU 120.

The ROM 112 functions to store various data such as map data and character data for the display on the display surface of the display unit 118.

The graphic controller 114 functions to generate display data by performing graphic processing by the use of the map data read from the ROM 112 according to the control by the CPU 120 and to output the display data to the display unit 118.

The video RAM 116 functions to temporarily store the display data generated by the graphic controller 114.

The display unit 118 functions to display an image according to the display data input from the graphic controller 114.

The display unit 118 is provided by a liquid crystal display in this preferred embodiment. However, various display units known in the art such as an organic EL display unit may be adopted as the display unit 118.

The CPU 120 operates according to the operation of the operating section 102 and functions to control the graphic controller 114 according to the position data supplied from the GPS processing section 106 and the map data supplied from the ROM 112, thereby displaying maps, characters, etc. on the display surface of the display unit 118. For example, the image to be displayed on the display surface of the display unit 118 includes an image such that a present position corresponding to the position data generated according to the positioning waves received by the GPS antenna 104 is indicated on the map data.

Figure 2:
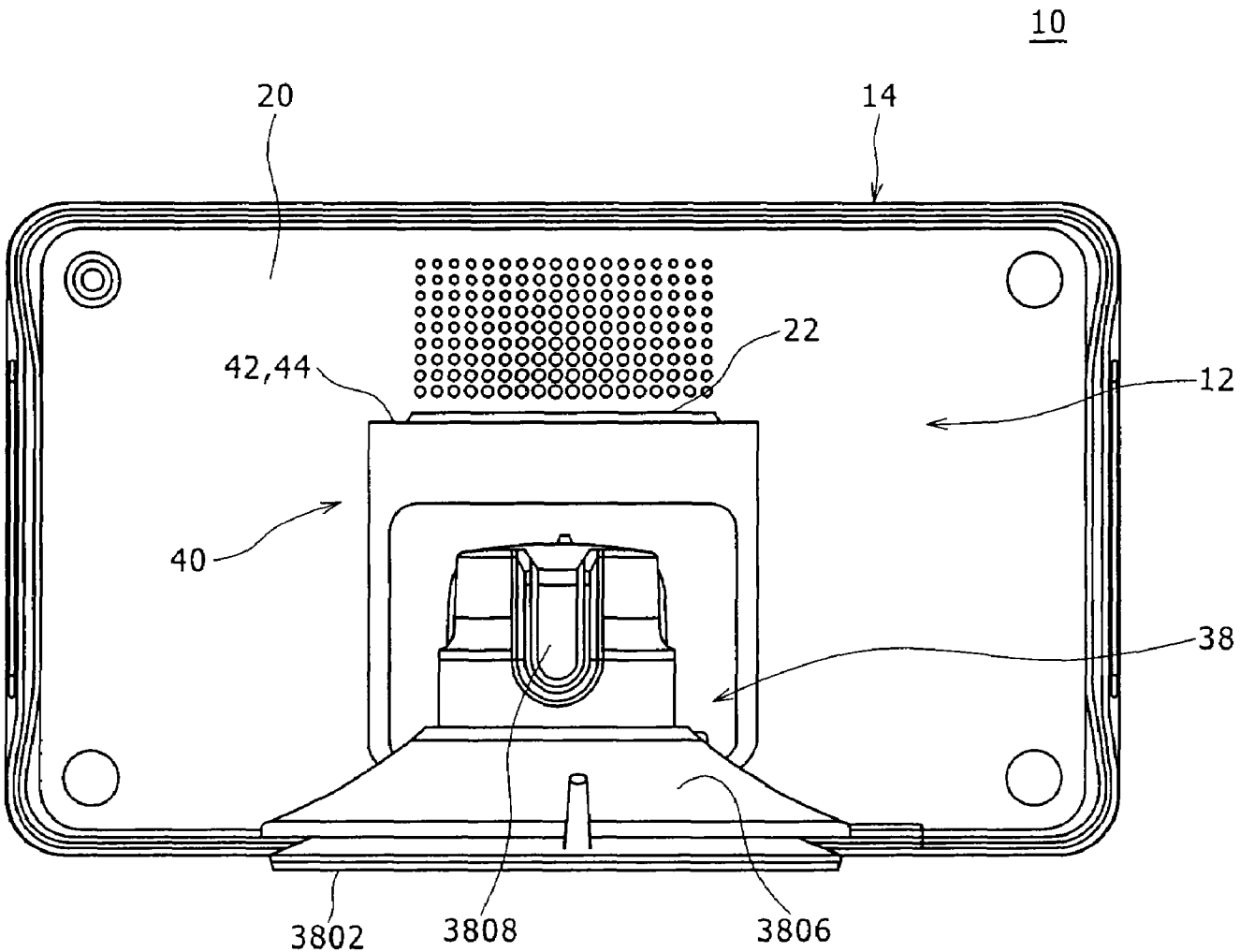
FIG. 2 is a rear elevational view of the electronic equipment unit.
Figure 3:
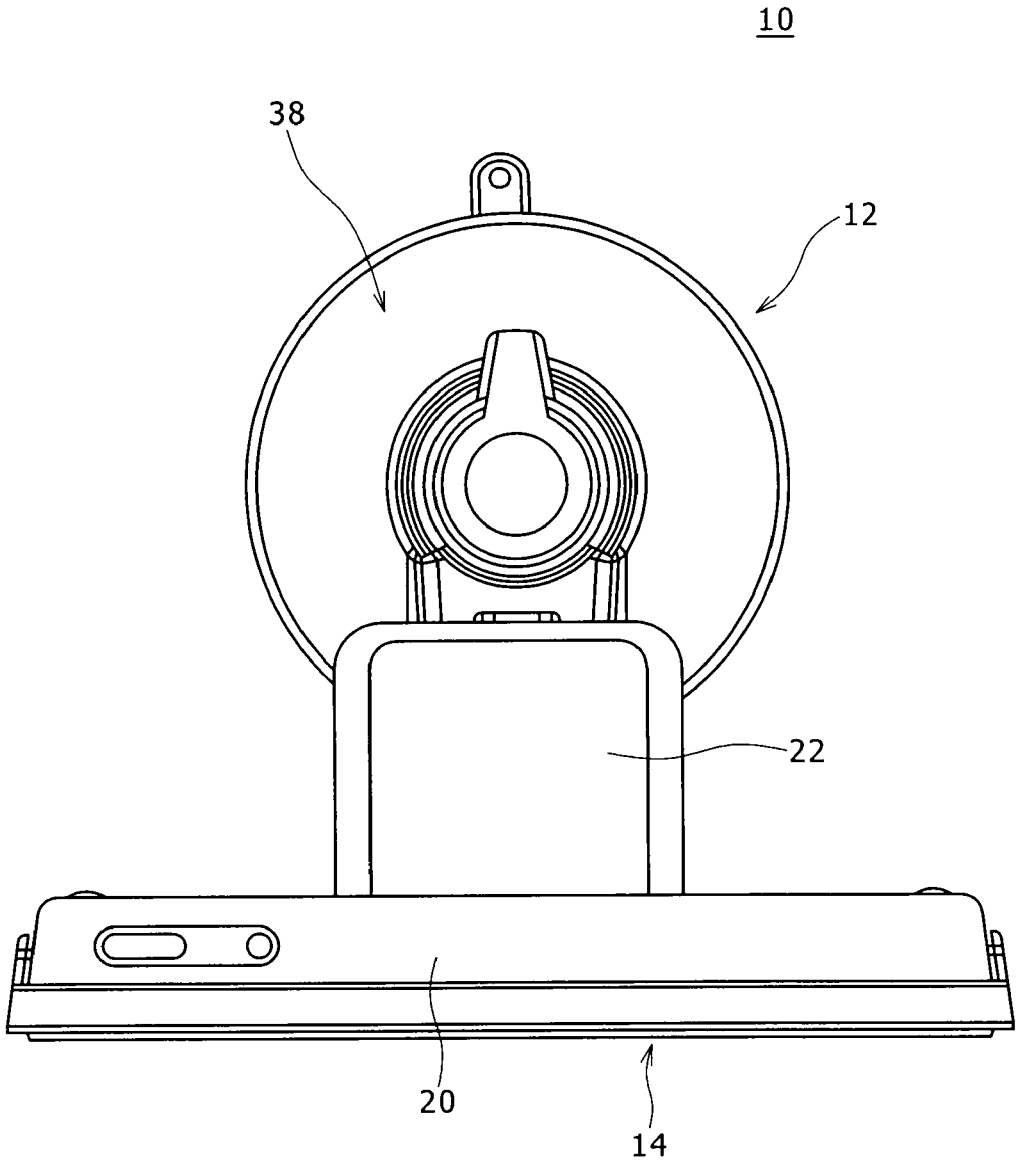
FIG. 3 is a top plan view of the electronic equipment unit.
Figure 4:
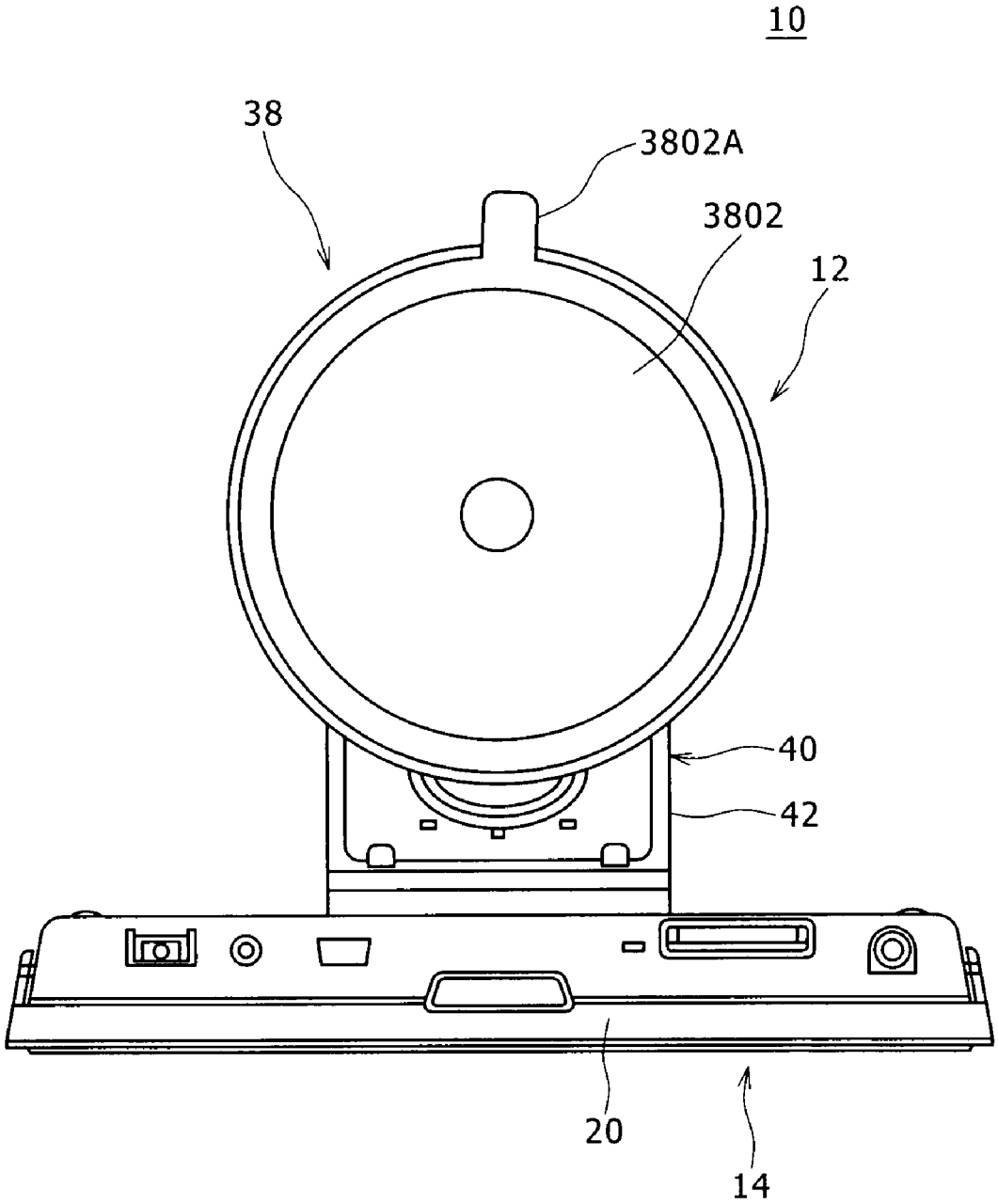
FIG. 4 is a bottom plan view of the electronic equipment unit.
Figure 5:
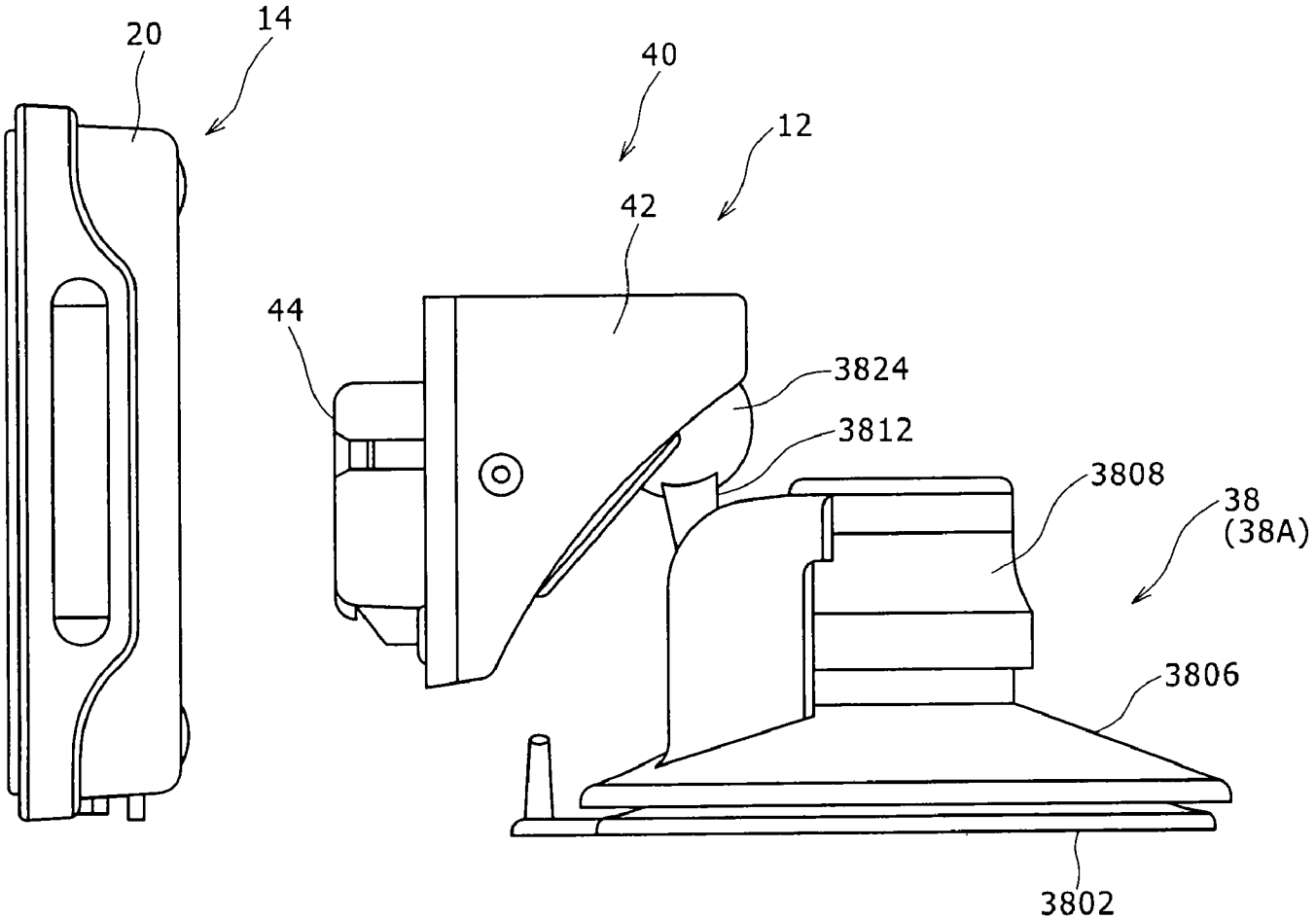
FIG. 5 is a side view showing a condition where electronic equipment is removed from a cradle.
Figure 6:
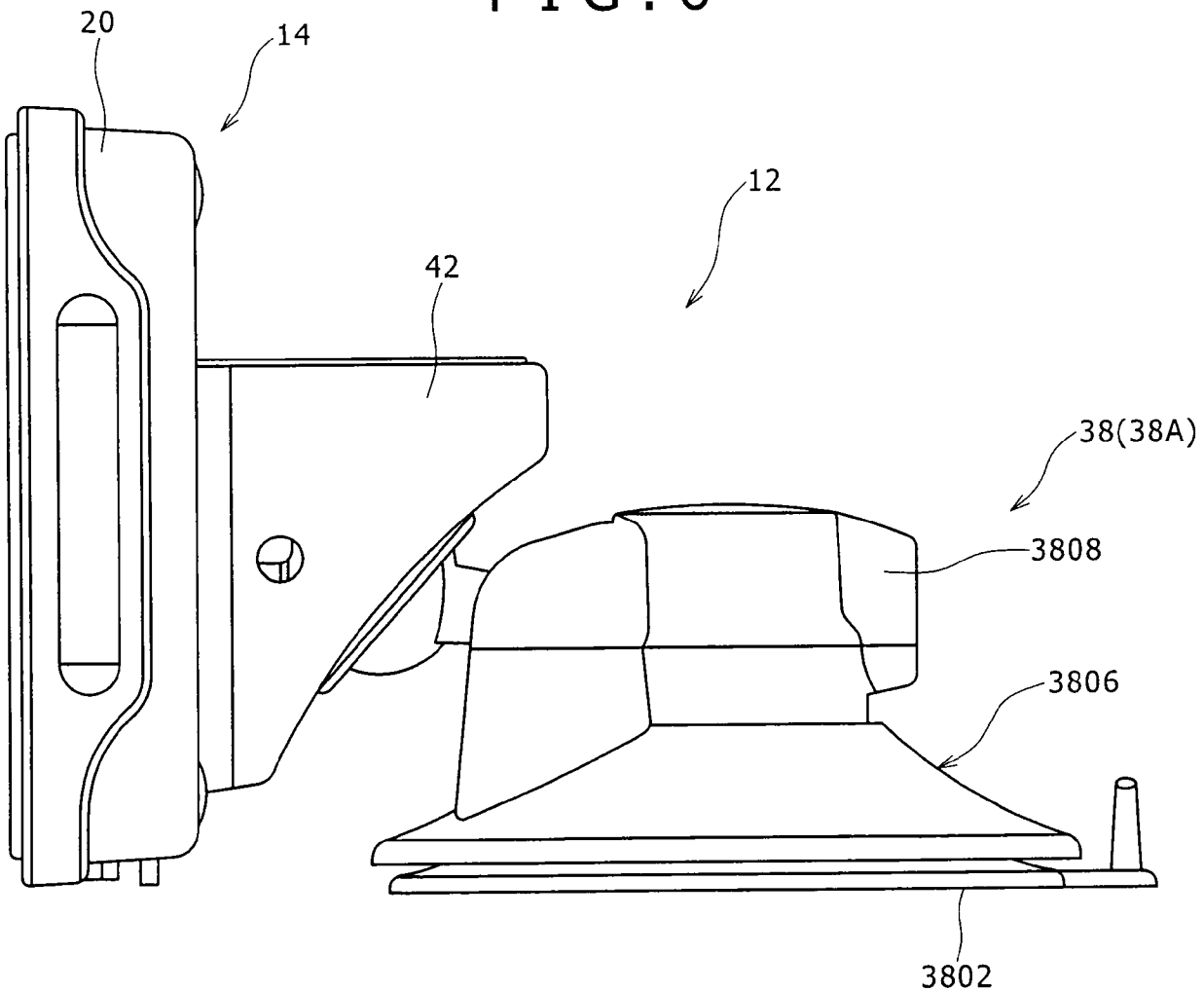
FIG. 6 is a side view showing a condition where the electronic equipment is mounted on the cradle.

FIG. 1 is a front perspective view of the electronic equipment unit 10, FIG. 2 is a rear elevational view of the electronic equipment unit 10, FIG. 3 is a top plan view of the electronic equipment unit 10, FIG. 4 is a bottom plan view of the electronic equipment unit 10, FIG. 5 is a side view showing a condition where electronic equipment 14 is removed from a cradle 12, and FIG. 6 is a side view showing a condition where the electronic equipment 14 is mounted on the cradle 12.

Figure 7:
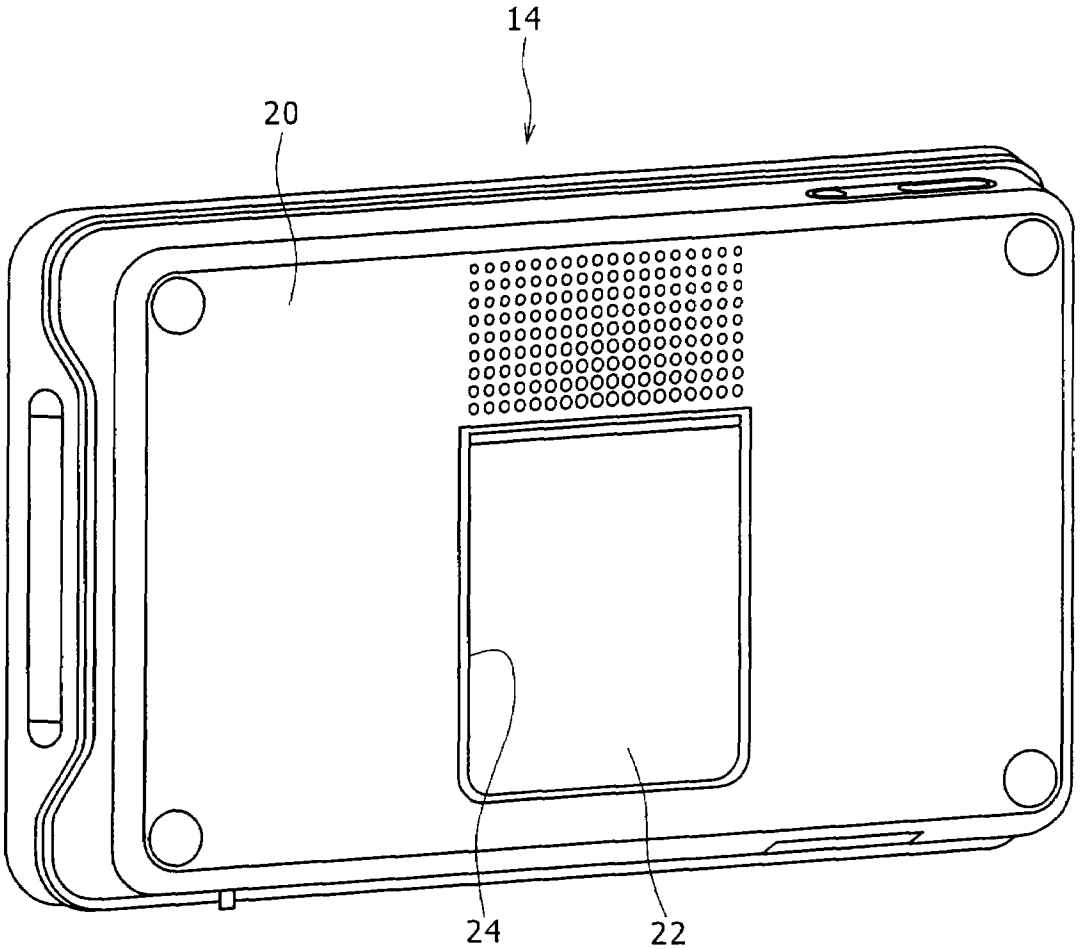
FIG. 7 is a rear perspective view of the electronic equipment in the condition where an antenna case is retracted.
Figure 8A:
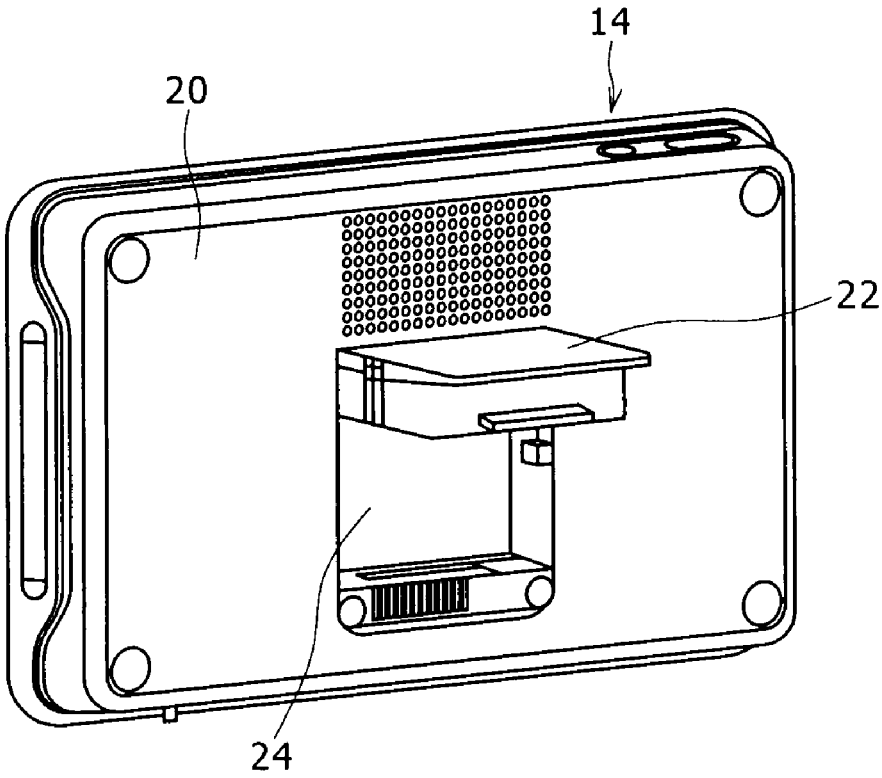
FIG. 8A is a rear perspective view of the electronic equipment in the condition where the antenna case is raised.
Figure 8B:
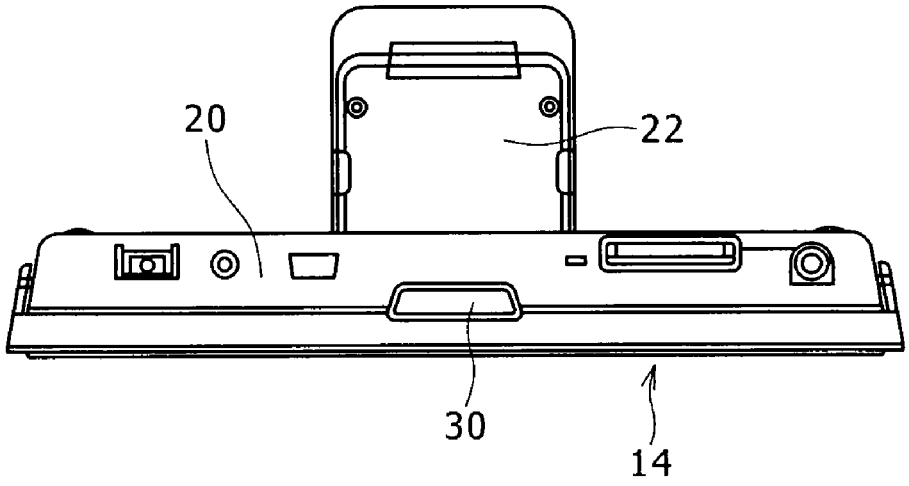
FIG. 8B is a bottom plan view of the electronic equipment in the raised condition of the antenna case.
Figure 9:
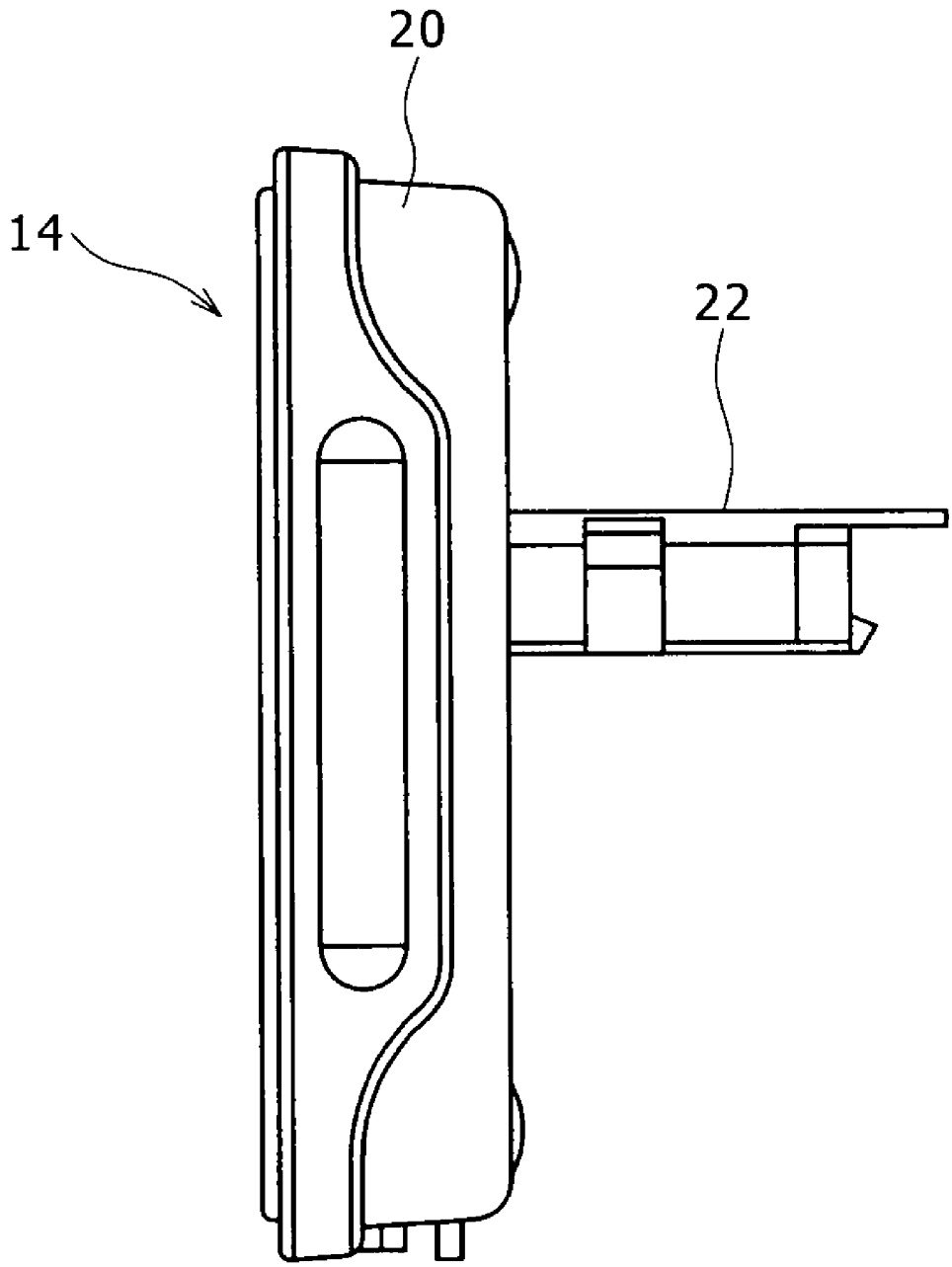
FIG. 9 is a side view of the electronic equipment in the raised condition of the antenna case.

FIG. 7 is a rear perspective view of the electronic equipment 14 in the condition where an antenna case 22 is retracted, FIG. 8A is a rear perspective view of the electronic equipment 14 in the condition where the antenna case 22 is raised, FIG. 8B is a bottom plan view of the electronic equipment 14 in the raised condition of the antenna case 22, and FIG. 9 is a side view of the electronic equipment 14 in the raised condition of the antenna case 22.

Figure 10B:
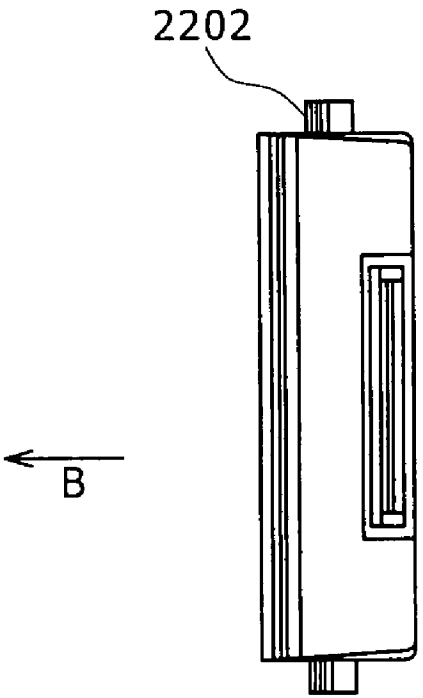
FIG. 10B is a view taken in the direction shown by an arrow B in FIG. 10A.
Figure 10A:
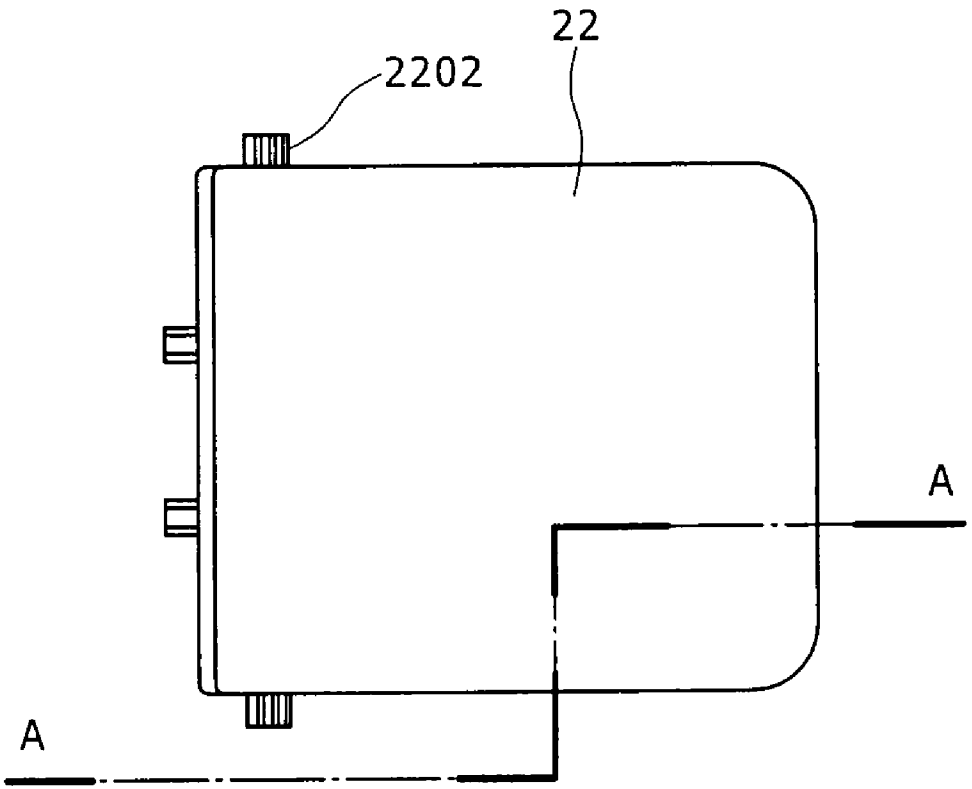
FIG. 10A is a top plan view of the antenna case.
Figure 11A:
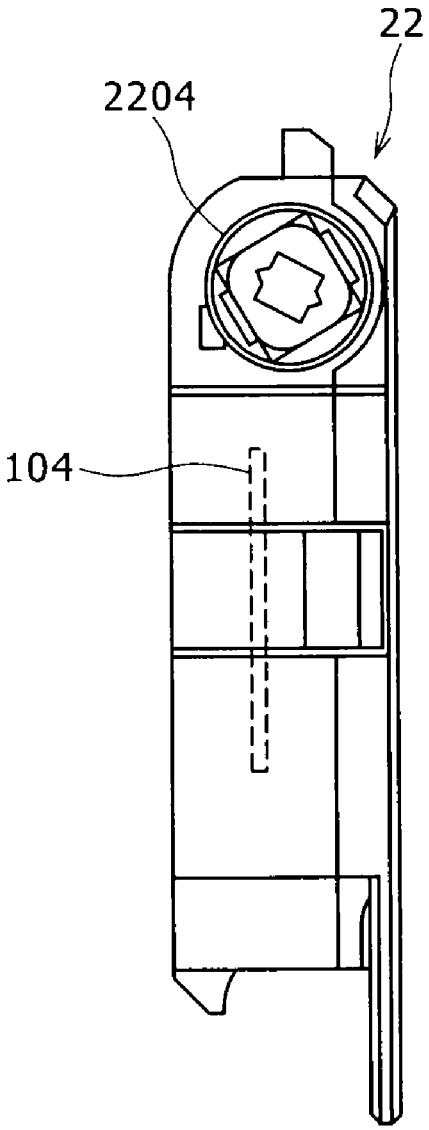
FIG. 11A is a side view of the antenna case.
Figure 11B:
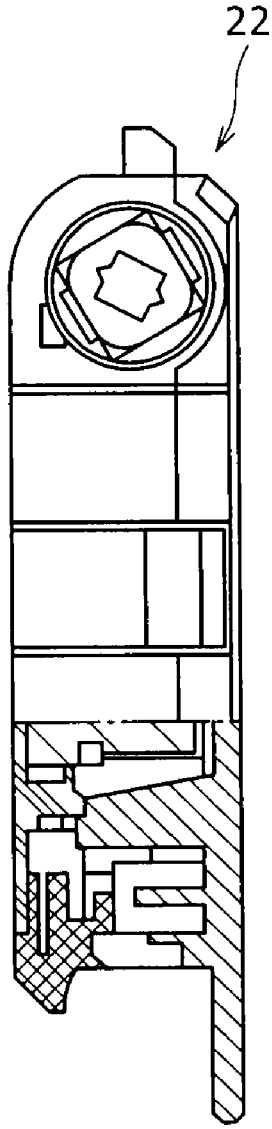
FIG. 11B is a cross section taken along the line A-A in FIG. 10A.

FIG. 10A is a top plan view of the antenna case 22, FIG. 10B is a view taken in the direction shown by an arrow B in FIG. 10A, FIG. 11A is a side view of the antenna case 22, and FIG. 11B is a cross section taken along the line A-A in FIG. 10A.

Figure 12:
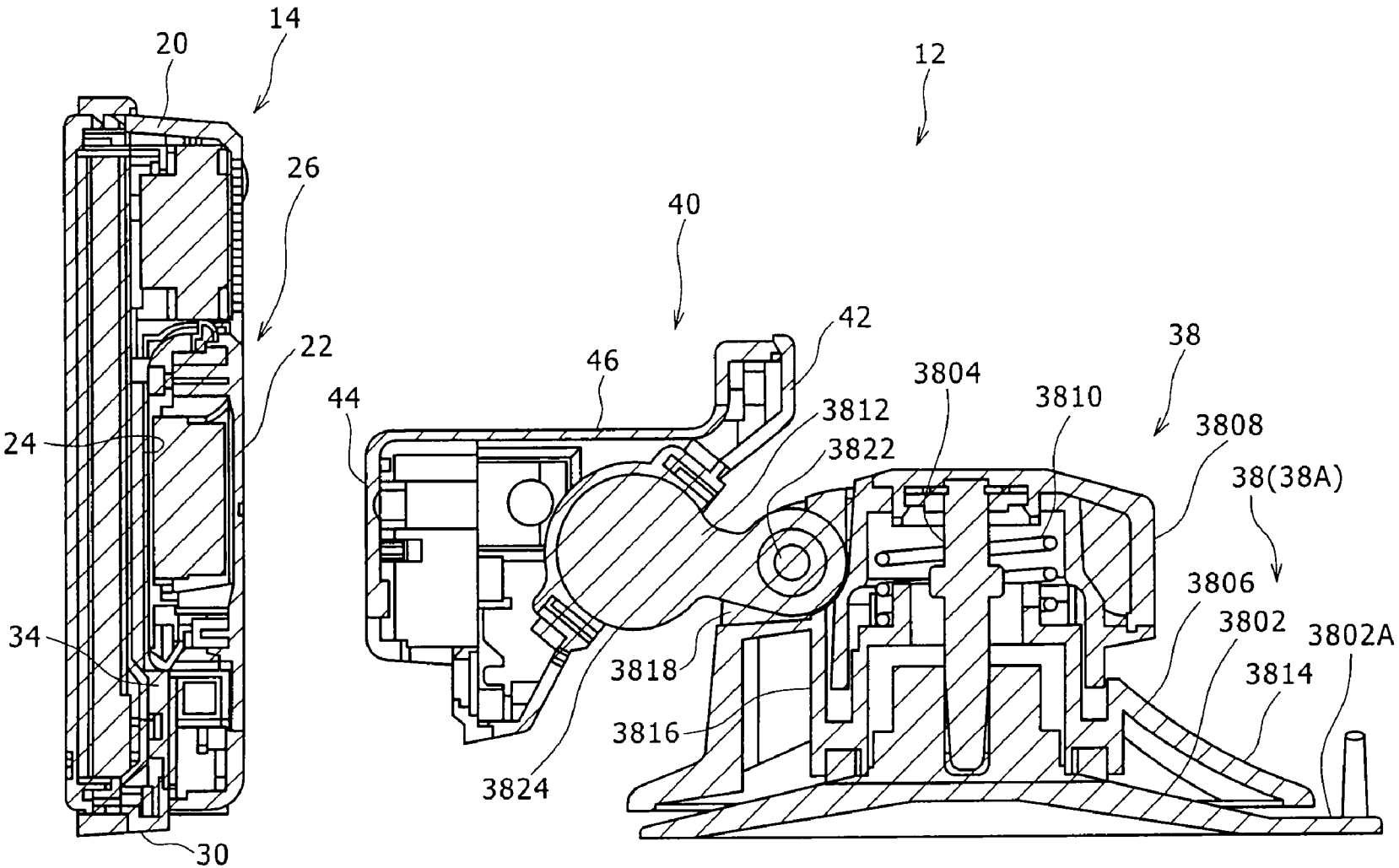
FIGS. 12, 13, and 14 are sectional views for illustrating the operation of mounting/demounting the electronic equipment to/from the cradle.
Figure 13:
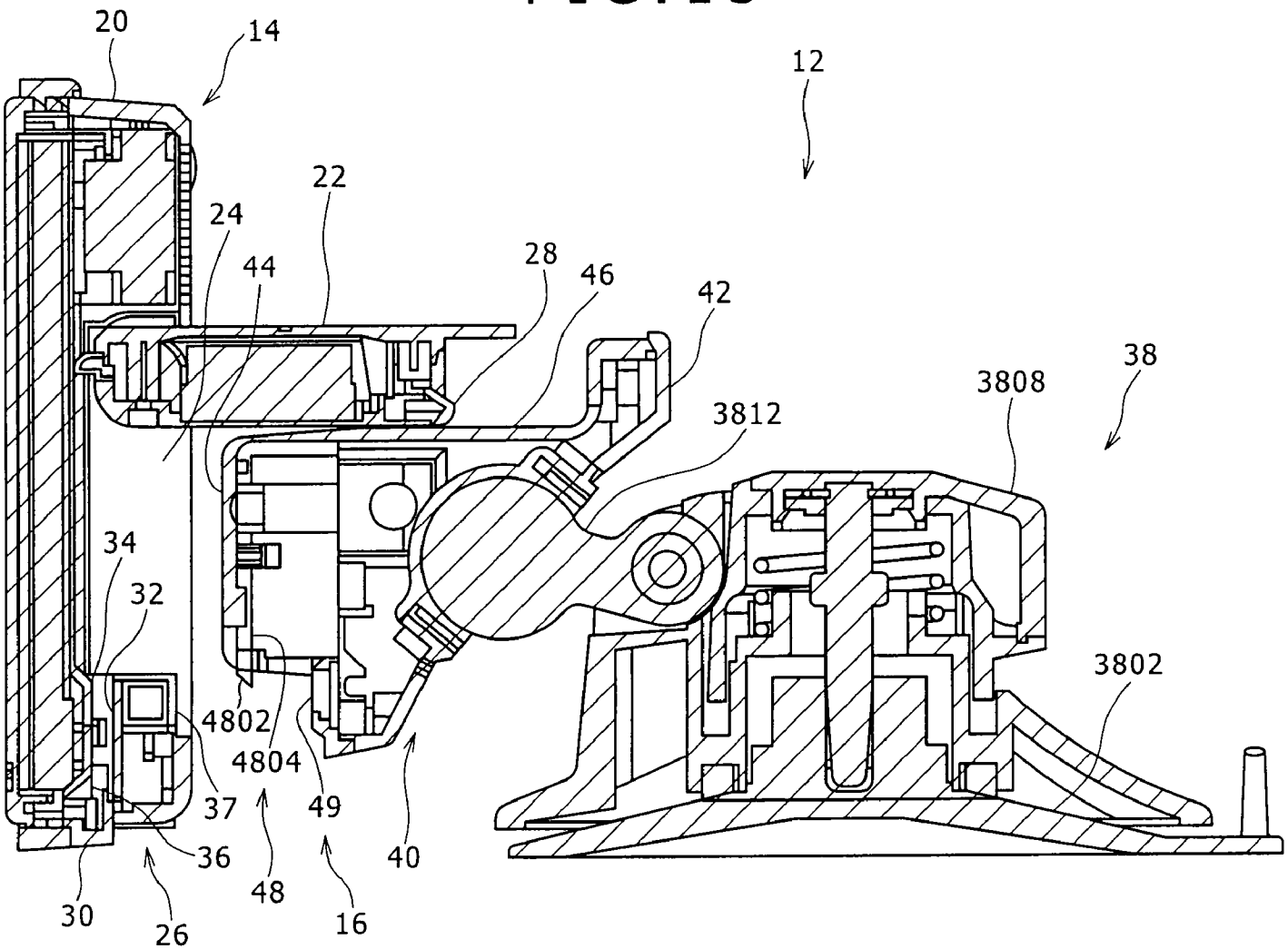
Figure 14:
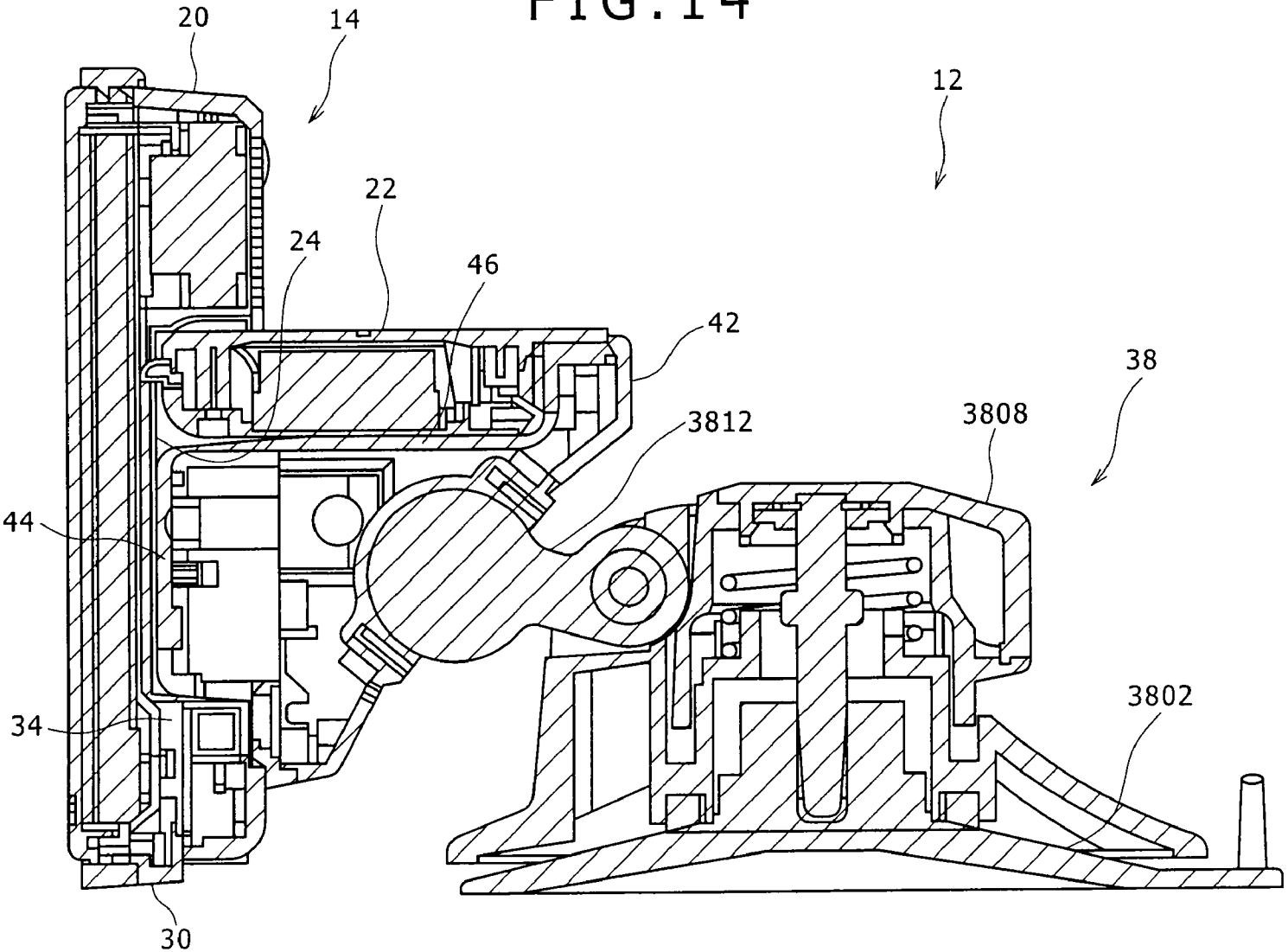

FIGS. 12 to 14 are sectional views for illustrating the operation of mounting/demounting the electronic equipment 14 to/from the cradle 12.

As shown in FIGS. 1 to 6, the electronic equipment unit 10 includes the cradle 12 adapted to be attached to a vehicle (e.g., dashboard or windshield), the electronic equipment 14 detachably mounted on the cradle 12, and a connecting mechanism 16 (see FIG. 13) for removably connecting the electronic equipment 14 to the cradle 12.

As shown in FIGS. 1, 7, and 8A, the electronic equipment 14 includes the display unit 118 mentioned above, a housing 20, the antenna case 22 containing the GPS antenna 104 (see FIG. 11A), and a recess 24 for receiving the antenna case 22 in its retracted condition.

The housing 20 is a rectangular platelike member having a thickness as the distance between the front side and the back side of the housing 20, a height larger than the thickness, and a width larger than the height.

An operating member 30 of an antenna case engaging mechanism 26 (see FIGS. 8B and 12) included in the connecting mechanism 16 to be hereinafter described in detail is provided on the lower end surface of the housing 20. Alternatively, the operating member 30 may be provided on the upper end surface of the housing 20.

As shown in FIG. 1, the display unit 118 has a display surface 118A provided on the front side of the housing 20.

The display surface 118A functions to display an image such as a map according to the position data indicative of the position of the electronic equipment unit 10 whose position data is obtained according to the positioning waves received by the GPS antenna 104.

As shown in FIGS. 8A and 13, the recess 24 is formed on the back side of the housing 20.

The recess 24 has a depth extending along the thickness of the housing 20 in the direction connecting the front side and the back side of the housing 20.

The antenna case 22 is pivotably supported through a pivot shaft 2202 shown in FIGS. 10A and 10B to the housing 20 so as to be pivotable between the retracted condition (see FIGS. 7 and 12) where the antenna case 22 is retracted in the recess 24 and the raised condition (see FIGS. 8A, 8B, 9, and 13) where the antenna case 22 is raised from the back side of the housing 20.

In this preferred embodiment, the pivot shaft 2202 (the center of pivot motion) of the antenna case 22 is located at an upper portion of the recess 24 in the condition where the height of the housing 20 extends in the vertical direction.

A torsion spring 2204 (see FIG. 11A) is provided between the pivot shaft 2202 and the antenna case 22, so that the antenna case 22 is normally biased by the torsion spring 2204 to maintain the raised condition.

The antenna case 22 has a thickness corresponding to the depth of the recess 24 in the retracted condition, and as shown in FIG. 11A, the GPS antenna 104 contained in the antenna case 22 extends in a plane perpendicular to the direction of the thickness of the antenna case 22.

Accordingly, the GPS antenna 104 extends in a horizontal plane in the condition where the housing 20 is positioned so that the height of the housing 20 extends in the vertical direction and the width of the housing 20 extends in the horizontal direction and that the antenna case 22 is raised from the back side of the housing 20 as shown in FIG. 8A.

As shown in FIG. 13, the antenna case engaging mechanism 26 for releasably engaging the antenna case 22 to hold and release the retracted condition of the antenna case 22 is provided in the housing 20 and the antenna case 22 in combination.

The antenna case engaging mechanism 26 includes an engaging lug 28 retractably provided in the antenna case 22 so as to be normally biased in a direction of projection from the antenna case 22, the operating member 30 provided on the lower end surface of the housing 20, an engaging groove 32 formed on the inner wall surface of the recess 24 of the housing 20 and adapted to engage with the engaging lug 28 in the retracted condition of the antenna case 22, a releasing lug 34 adapted to engage with the engaging lug 28 engaged with the engaging groove 32 for releasing the engaging lug 28 from the engaging groove 32 by the operation of the operating member 30, and a biasing member 36 for biasing the releasing lug 34 in a direction of separating the releasing lug 34 from the engaging lug 28 engaged with the engaging groove 32 and for also biasing the operating member 30 in a direction of projecting the operating member 30 from the lower end surface of the housing 20.

In FIG. 13, reference numeral 37 denotes an electrical connector provided in the recess 24 of the housing 20.

As shown in FIG. 5, the cradle 12 includes a body portion 38 adapted to be attached to a vehicle and an electronic equipment mounting portion 40 connected to the body portion 38 so as to be tiltable and rotatable.

In this preferred embodiment, the body portion 38 is provided by using a suction cup unit 38A, which is adapted to be detachably attached to a dashboard or a windshield in a vehicle, for example.

As shown in FIGS. 5 and 12, the suction cup unit 38A includes a suction cup 3802, center shaft 3804, base member 3806, lock lever 3808, coil spring 3810, connecting arm 3812 and the like.

As shown in FIG. 12, the suction cup 3802 is a disk-shaped member, which has a concave suction surface on one side or front side and a convex surface on the other side or back side in the direction of the thickness of the suction cup 3802. A tabular portion 3802A is formed on the outer circumference of the suction cup 3802 so as to extend radially outward. The tabular portion 3802A is used in removing the suction cup 3802 from the vehicle.

Various configurations known in the art may be adopted as the suction cup 3802.

The center shaft 3804 projects from the center of the convex surface of the suction cup 3802 in such a manner that the lower end of the center shaft 3804 is inserted in a central projecting portion of the suction cup 3802.

The base member 3806 has a skirt portion 3814 for covering the convex surface of the suction cup 3802 and an outer cylindrical portion 3816 formed radially inside of the skirt portion 3814 so as to surround the central projecting portion of the suction cup 3802.

The outer circumference of the skirt portion 3814 is adapted to come into contact with the convex surface of the suction cup 3802. Alternatively, the outer circumference of the skirt portion 3814 may come into contact with the surface of the vehicle at a position radially outside of the suction cup 3802.

The outer cylindrical portion 3816 projects from the center of the skirt portion 3814 so as to surround the center shaft 3804.

A wall portion 3818 projects radially outward from the outer cylindrical portion 3816, and the base end of the connecting arm 3812 is pivotably supported through a pivot shaft 3822 to the wall portion 3818. Various connecting structures known in the art may be adopted for the mounting of the connecting arm 3812 to the wall portion 3818. Such connecting structures may include, for example, a frictional resistance type bearing mechanism such that any desired tilted condition of the connecting arm 3812 can be held by a frictional force and a click mechanism such that a holding force for the connecting arm 3812 can be stepwise obtained at given tilt angles.

The lock lever 3808 is connected to the upper end of the center shaft 3804 so as to be unmovable in the axial direction of the center shaft 3804 and rotatable about the center shaft 3804 between an initial position and a lock position.

The coil spring 3810 is provided so as to surround the center shaft 3804. The coil spring 3810 functions to bias the lock lever 3808 to the initial position and to bias the lock lever 3808 in a direction of separating the lock lever 3808 from the base member 3806 along the center shaft 3804.

The suction cup unit 38A is attached to the surface of the vehicle in the following manner. First, the suction surface of the suction cup 3802 is put on the surface of the vehicle, and the top of the lock lever 3808 is next depressed to bring the suction surface into attachment to the surface of the vehicle by suction (initial sucked condition).

The lock lever 3808 is next rotated from this initial position to bring the outer circumference of the skirt portion 3814 into contact with the convex surface of the suction cup 3802 by the action of a cam mechanism (not shown) provided between the lock lever 3808 and the base member 3806, thereby forcibly displacing the center shaft 3804 in a direction of moving the center shaft 3804 away from the surface of the vehicle (final sucked condition). Thus, the suction cup 3802 is firmly attached to the surface of the vehicle.

Further, the removal of the suction cup unit 38A from the surface of the vehicle can be effected by holding the tabular portion 3802A of the suction cup 3802 and separating the suction cup 3802 from the surface of the vehicle.

Further, various structures known in the art may be adopted for the suction cup unit 38A. For example, the base member 3806 and the cam mechanism may be eliminated and the connecting arm 3812 may be provided at the top of the center shaft 3804.

Further instead of the suction cup unit 38A, the body portion 38 may have a base member adapted to be mounted on the surface of the vehicle by using screws or by using a double faced tape.

A spherical portion 3824 is formed at the front end of the connecting arm 3812, and the electronic equipment mounting portion 40 is tiltably and rotatably connected to the spherical portion 3824. Various connecting structures known in the art may be adopted for the connection between the connecting arm 3812 and the electronic equipment mounting portion 40. For example, such connecting structures may include a frictional resistance type bearing mechanism such that any desired tilted condition of the electronic equipment mounting portion 40 can be held by a frictional force.

The electronic equipment mounting portion 40 has a case 42. As shown in FIGS. 13 and 14, the case 42 has a case portion adapted to be received into the recess 24 of the housing 20 in the raised condition of the antenna case 22. In this preferred embodiment, this case portion constitutes a connecting portion 44. Accordingly, the connecting portion 44 corresponds to a connecting case portion of the case 42.

As shown in FIGS. 12 and 13, a recess 46 is formed at the upper portion of the connecting portion 44. The recess 46 of the connecting portion 44 functions to receive the antenna case 22 in the condition where the antenna case 22 is raised and the connecting portion 44 is received in the recess 24 of the housing 20 in such a manner that the upper surface of the antenna case 22 appears to be flush with the upper surface of the connecting portion 44 (see FIG. 2), thereby providing a feeling of integration of the antenna case 22 and the connecting portion 44.

As shown in FIG. 14, in the condition where the antenna case 22 is received in the recess 46 of the connecting portion 44 and the connecting portion 44 is received in the recess 24 of the housing 20, the upper surface of the antenna case 22 abuts against the side wall surface of the recess 24, and the inner side surface of the antenna case 22 abuts against the bottom surface of the recess 24, thereby stably holding the raised condition of the antenna case 22.

As shown in FIG. 13, the connecting portion 44 is provided with a connecting portion engaging mechanism 48. The connecting portion engaging mechanism 48 includes an engaging lug 4802 adapted to engage with the engaging groove 32 and engageable with the releasing lug 34 in the condition where the connecting portion 44 is received in the recess 24 of the housing 20 and adapted to be released from the engaging groove 32 through the releasing lug 34 by the operation of the operating member 30, and a biasing member 4804 for biasing the engaging lug 4802 in a direction of engaging the engaging lug 4802 into the engaging groove 32.

The connecting mechanism 16 functions to detachably connecting the connecting portion 44 to the recess 24 in the raised condition of the antenna case 22.

Accordingly, in this preferred embodiment, the connecting mechanism 16 includes the antenna case engaging mechanism 26 and the connecting portion engaging mechanism 48. More specifically, the connecting mechanism 16 includes the operating member 30, the engaging groove 32, the releasing lug 34, and the biasing member 36 as some of the components of the antenna case engaging mechanism 26 and also includes the engaging lug 4802 and the biasing member 4804 as all of the components of the connecting portion engaging mechanism 48.

Accordingly, in this preferred embodiment, the connecting mechanism 16 functions to releasably engage the antenna case 22 to hold and release the retracted condition of the antenna case 22.

In FIG. 13, reference numeral 49 denotes an electrical connector provided on the connecting portion 44. The electrical connector 49 of the cradle 12 is connected to the electrical connector 37 of the electronic equipment 14 when the connecting portion 44 is received into the recess 24, thereby supplying electrical power from a power supply (not shown) provided in the vehicle as a mobile unit through the connectors 49 and 37 to the electronic equipment 14.

Various structures known in the art may be adopted for the antenna case engaging mechanism 26 and the connecting portion engaging mechanism 48. For example, the housing 20 may includes an operating member and an engaging lug adapted to be operated by the operating member, while each of the antenna case 22 and the connecting portion 44 may include an engaging groove adapted to engage with the engaging lug of the housing 20. As another modification, second and third engaging lugs may be provided at the right and left side portions of the connecting portion 44 so as to be operated in concert with the engaging lug 4802, while second and third engaging grooves for engaging these second and third engaging lugs of the connecting portion 44 are formed on the inner side wall of the recess 24 in addition to the engaging groove 32. With this configuration, the connected condition of the connecting portion to the recess 24 can be made stabler.

The mounting and demounting of the electronic equipment 14 will now be described.

The suction cup 3802 is attached to a windshield or a dashboard in a vehicle, for example, to thereby mount the cradle 12 on the vehicle.

In the case of mounting the electronic equipment 14 to the cradle 12, the operating member 30 is depressed to thereby project the releasing lug 34, so that the engaging lug 28 is disengaged from the engaging groove 32. As a result, the antenna case 22 is pivotally moved from the retracted condition shown in FIG. 12 to the raised condition shown in FIG. 13 by the torsion spring 2204.

In the raised condition of the antenna case 22, the connecting portion 44 is inserted into the recess 24, so that the engaging lug 4802 is engaged into the engaging groove 32. As a result, the connecting portion 44 is connected with the recess 24 as shown in FIG. 14.

In the case of demounting the electronic equipment 14 from the cradle 12, the operating member 30 is depressed to thereby project the releasing lug 34, so that the engaging lug 4802 is disengaged from the engaging groove 32. As a result, the electronic equipment 14 is removed from the connecting portion 44.

Thus, the electronic equipment 14 is demounted from the cradle 12. Finally, the antenna case 22 is retracted into the recess 24, so that the engaging lug 28 is engaged into the engaging groove 32, thereby holding the retracted condition of the antenna case 22.

The operation and effect of this preferred embodiment will now be described.

The connecting portion 44 is connected to the recess 24 in the condition where the former is received in the latter. In other words, the electronic equipment 14 is connected to the cradle 12 by utilizing the recess 24. Accordingly, the mounted or connected condition of the electronic equipment 14 to the cradle 12 can be made compact.

The depth of the recess 24 extends in the direction of the thickness of the housing 20. Accordingly, the mounting/demounting of the electronic equipment 14 to/from the cradle 12 can be attained by linearly moving the housing 20 in the direction of the thickness thereof. As a result, the mounting/demounting of the electronic equipment 14 to/from the cradle 12 can be simply attained.

More specifically, in the case that the mounting/demounting of the electronic equipment 14 to/from the cradle 12 is attained by rotating the electronic equipment 14 or by linearly moving the electronic equipment 14 in a direction perpendicular to the direction of the thickness of the housing 20, a wide space is necessary around the electronic equipment 14 and the cradle 12.

To the contrary, according to this preferred embodiment, the mounting/demounting of the electronic equipment 14 to/from the cradle 12 can be attained by linearly moving the housing 20 in the direction of the thickness thereof. Accordingly, the electronic equipment unit 10 can be easily set even at a position where a wide space cannot be ensured around the electronic equipment unit 10. Thus, in addition to the first effect that the electronic equipment 14 can be simply mounted and demounted, it is possible to exhibit the second effect that the electronic equipment 14 can be set at a desired position, thereby improving the usability.

The housing 20 is a laterally elongated, rectangular plate-like member, and the operating member 30 of the connecting mechanism 16 is provided on the lower end surface of the housing 20. Accordingly, the operating member 30 can be operated with an operator's hand holding the housing 20, so that the mounting/demounting of the electronic equipment 14 to/from the cradle 12 can be performed more simply. More specifically, it is unnecessary to use both hands in performing the mounting/demounting of the electronic equipment 14 to/from the cradle 12, but the operating member 30 can be operated with one hand in the condition where the upper end surface and the lower end surface of the housing 20 are held by the one hand, so that the mounting/demounting of the electronic equipment 14 to/from the cradle 12 can be performed more simply.

Further, in the condition where the housing 20 is positioned so that the height of the housing 20 extends in the vertical direction and the width of the housing 20 extends in the horizontal direction, the antenna case 22 in the raised condition extends in a horizontal plane, so that the GPS antenna 104 in the antenna case 22 also extends in a horizontal plane.

Accordingly, the positioning waves transmitted from a GPS satellite toward the surface of the earth can be efficiently received by the GPS antenna 104.

Further, in the condition where the connecting portion 44 is connected with the recess 24, the upper surface of the antenna case 22 appears to be flush with the upper surface of the connecting portion 44, so that a feeling of integration of the electronic equipment 14 and the cradle 12 can be obtained to thereby improve the appearance.

Further, the antenna case 22 is received in the recess 46 of the connecting portion 44 in the condition where the connecting portion 44 is connected with the recess 24 of the housing 20, so that the raised condition of the antenna case 22 can be stably held to thereby prevent the rattle of the antenna case 22 in the raised condition. Further, it is possible to prevent damage to the antenna case 22 in the raised condition upon application of an external force thereto.

In this preferred embodiment, the electronic equipment 14 of the electronic equipment unit 10 is a personal navigation device. As a modification, the electronic equipment 14 may have a function of displaying a video image on the display surface 118A according to television broadcast waves. As another modification, the electronic equipment 14 may have a function of displaying a video image on the display surface 118A according to information reproduced from a disk-shaped recording medium such as a DVD. Thus, the electronic equipment unit 10 is widely applicable to any devices having various functions and uses.

While the mobile unit is a vehicle in this preferred embodiment, the mobile unit is not limited to a vehicle in the embodiment according to the present invention, but may include not only a land mobile unit such as automobile, motorcycle, and train, but also a water-surface mobile unit such as a yacht and boat.

Further, the electronic equipment unit may be attached not only to a mobile unit, but also to any fixed body such as an interior body in a building.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. An electronic equipment unit comprising:

a cradle adapted to be attached to a mobile unit;

electronic equipment detachably mounted to said cradle; and a connecting mechanism configured to detachably connect said electronic equipment to said cradle;

said electronic equipment including a housing, an antenna case connected to the back side of said housing configured to contain a GPS antenna, a recess formed on the back side of said housing configured to receive said antenna case, and a display surface formed on the front side of said housing configured to display an image according to positioning waves received by said GPS antenna;

said antenna case being pivotable between a retracted condition where said antenna case is retracted in said recess and a raised condition where said antenna case is raised from the back side of said housing;

said cradle having a connecting portion adapted to be received in said recess in the raised condition of said antenna case;

said connecting portion of said cradle being detachably connected to said recess by said connecting mechanism in the condition where said antenna case is raised and said connecting portion is received in said recess.

2. The electronic equipment unit according to claim 1, wherein:

said recess has a depth extending along the thickness of said housing in the direction connecting the front side and the back side of said housing; and the connection/disconnection of said connecting portion to/from said recess is attained by linearly moving said housing in the direction of the thickness thereof.

3. The electronic equipment unit according to claim 1, wherein:

said recess has a depth extending along the thickness of said housing in the direction connecting the front side and the back side of said housing;

the connection/disconnection of said connecting portion to/from said recess is attained by linearly moving said housing in the direction of the thickness thereof;

said housing is a rectangular platelike member having said thickness, a height larger than said thickness, and a width larger than said height;

said connecting mechanism having an operating member for use in performing the connection/disconnection of said connecting portion to/from said recess; and said operating member is provided on the upper end surface or lower end surface of said housing as the opposite end surfaces in the direction of the height thereof.

4. The electronic equipment unit according to claim 1, wherein said connecting mechanism has a biasing member for biasing said antenna case to the raised condition thereof, and an antenna case engaging mechanism provided in said housing and said antenna case in combination for releasably engaging said antenna case to hold and release the retracted condition of said antenna case.

5. The electronic equipment unit according to claim 1, wherein said connecting mechanism also functions to releasably engage said antenna case to hold and release the retracted condition of said antenna case.

6. The electronic equipment unit according to claim 1, wherein said connecting mechanism comprises an antenna case engaging mechanism and a connecting portion engaging mechanism:

said antenna case engaging mechanism including a first engaging lug retractably provided in said antenna case so as to be normally biased in a direction of projection from said antenna case, an operating member provided on said housing, an engaging groove formed on the inner wall surface of said recess and adapted to engage with said first engaging lug in the retracted condition of said antenna case, a releasing lug adapted to engage with said first engaging lug engaged with said engaging groove for releasing said first engaging lug from said engaging groove by the operation of said operating member, and a first biasing member for biasing said releasing lug in a direction of separating said releasing lug from said first engaging lug engaged with said engaging groove; and said connecting portion engaging mechanism including a second engaging lug adapted to engage with said engaging groove and engageable with said releasing lug in the condition where said connecting portion is received in said recess and adapted to be released from said engaging groove through said releasing lug by the operation of said operating member, and a second biasing member for biasing said second engaging lug in a direction of engaging said second engaging lug into said engaging groove.

7. The electronic equipment unit according to claim 1, wherein:

said housing is a rectangular platelike member having a thickness extending in the direction connecting the front side and the back side of said housing, a height larger than said thickness, and a width larger than said height; and said GPS antenna contained in said antenna case extends in a plane perpendicular to the direction of the thickness of said antenna case, whereby said GPS antenna extends in a horizontal plane in the condition where said housing is positioned so that the height of said housing extends in the vertical direction and the width of said housing extends in the horizontal direction and that said antenna case is raised from the back side of said housing.

8. The electronic equipment unit according to claim 1, wherein said connecting portion is formed at its upper portion with a recess for receiving said antenna case in the condition where said antenna case is raised and said connecting portion is received in said recess of said housing.

9. The electronic equipment unit according to claim 1, wherein said connecting portion is formed at its upper portion with a recess for receiving said antenna case in the condition where said antenna case is raised and said connecting portion is received in said recess of said housing in such a manner as to provide a feeling of integration of said antenna case and said connecting portion.

10. The electronic equipment unit according to claim 1, wherein:

said cradle comprises a body portion adapted to be attached to said mobile unit and an electronic equipment mounting portion tiltably and rotatably connected to said body portion; and said connecting portion is provided on said electronic equipment mounting portion.

11. The electronic equipment unit according to claim 1, wherein:

said electronic equipment comprises a personal navigation device; and said image to be displayed on said display surface includes an image such that a present position corresponding to position data generated according to said positioning waves received by said GPS antenna is indicated on map data.

12. The electronic equipment unit according to claim 1, wherein said electronic equipment has a function of displaying a video image on said display surface according to television broadcast waves.

13. The electronic equipment unit according to claim 1, wherein said electronic equipment has a function of displaying a video image on said display surface according to information reproduced from a disk-shaped recording medium.

* * * * *